US005211553A

United States Patent [19]

Menter

[11] Patent Number: 5,211,553

[45] Date of Patent: May 18, 1993

[54] BURNER FOR LIQUID FUEL CELL

[75] Inventor: J. Alan Menter, Manlius, N.Y.

[73] Assignee: Hollowick, Inc., Manlius, N.Y.

[21] Appl. No.: 840,523

[22] Filed: Feb. 25, 1992

[51] Int. Cl.[5] ..... F23D 3/24

[52] U.S. Cl. ..... 431/320; 431/325; 431/298; 126/45; 126/49

[58] Field of Search ..... 431/320, 325, 120, 125, 431/298, 301, 288, 203; 126/45, 49

[56] References Cited

U.S. PATENT DOCUMENTS

| | | | |
|---|---|---|---|
| 329,589 | 11/1885 | Painter | 431/325 |
| 4,234,303 | 11/1980 | Neugart | 431/320 X |
| 4,526,530 | 7/1985 | Menter et al. . | |
| 4,611,986 | 9/1986 | Menter et al. . | |
| 4,896,653 | 1/1990 | Eke et al. | 431/320 X |

*Primary Examiner*—Larry Jones

*Attorney, Agent, or Firm*—Wall and Roehrig

[57] ABSTRACT

A die-cut wick for use in the burner of a disposable fuel cell formed from a single sheet of wicking material so that the wick has two symmetrical half-sections situated on either side of a vertical center line and which are folded along the center line into a face-to-face alignment. Each half-section further includes an elongated lower body segment containing a horizontally-disposed upper edge, a narrow neck segment centered on the upper edge of the body segment and a tab vertically extending therefrom to a given height. The neck is slidably received within a burner of a fuel cell so that it can be raised or lowered between limits to control the flame height and the amount of heat produced by the burner. The tabs are foldable toward and away from each other to further control the flame geometry and distribution of the heat.

14 Claims, 1 Drawing Sheet

BURNER FOR LIQUID FUEL CELL

BACKGROUND OF THE INVENTION

This invention relates to a liquid fuel cell and, in particular, to a die-cut wick for use in a liquid fuel cell.

A die-cut wick for use in a liquid fuel cell is described in U.S. Pat. No. 4,611,986. The wick includes two symmetrical half-sections that can be folded in face-to-face alignment along a vertical center line. Each half-section further includes a lower body segment that has a horizontal top edge and a narrower upper tab segment centered upon the top edge of the body segment.

In assembly, the tabs are folded together and passed upwardly through the stem of a burner situated in the lid of a liquid fuel cell. The tabs are extended until the top edges of the body segments are arrested by the inside surface of the lid. The body segments are fanned out and glued to the inside of the lid to fix the tabs at a desired height above the lid. The body segments pass downwardly into the cell card carry fuel stored therein to the tabs by capillary action. In operation, the tabs are lighted and the amount of heat produced by the burner is controlled by adjusting the relative positions of the two tabs by folding them toward or away from each other.

The folded wick arrangement has worked well in practice and has shown itself to be a simple approach to controlling the flame, thus the heat output of a liquid fuel cell. The amount of control afforded by the fixed height tab, however, is limited. Gluing the body of the wick to the underside of the lid is not totally satisfactory in that the bond can be broken enabling the wick to be repositioned in the cell. The tabs of the wick will, under certain conditions, become over-saturated with fuel causing the lid of the cell to be wetted with fuel. The problem of over-saturation of a wick-equipped, disposable liquid fuel cell is addressed in U.S. Pat. No. 4,526,530. As disclosed in this patent, the stem of the burner is surrounded by a circular trough in which excess fuel is collected The trough has one or more ports that open into the fuel cell container to permit the excess fuel collected in the trough to drain back into the cell. The burner utilized in this fuel cell is rather complex and relatively expensive to manufacture thus raising the cost of the disposable cell.

SUMMARY OF THE INVENTION

It is a primary object of this invention to improve liquid fuel cells.

Another object of the present invention is to provide greater control over the flame height and amount of heat produced by a liquid fuel cell.

Still another object of the present invention is to provide an improved, foldable die-cut wick that is suitable for use in a liquid fuel cell.

A further object of the present invention is to provide a foldable die-cut wick for use in a liquid fuel cell that affords the user control over the flame height, the amount of heat produced by the cell, the flame geometry and the distribution of heat.

A still further object of the present invention is to prevent wetting of the lid of a liquid fuel cell which is equipped with a foldable wick.

Yet a further object of the present invention is to provide a relatively inexpensive burner for use in a disposable fuel cell which provides a wide range of control over the flame and heat produced by the cell.

These and other objects of the present invention are attained by means of a liquid fuel cell equipped with a wick that is die-cut from a sheet of wicking material so that the wick has two symmetrical half-sections situated on either side of a vertical center line. Each half-section further contains a lower body segment and an upper tab segment that are connected by a narrower neck segment having a pre-determined length. In assembly, the wick is folded along the center line and the neck of the wick is slidably contained within a vertically-disposed stud that forms part of the cell's burner. The length of the neck is greater than the height of the stud thus allowing the wick to be raised and lowered within the burner to control the flame height and the amount of heat that is produced by the cell. In addition, the tab segments of the wick can be folded or unfolded to provide further control over the flame geometry and distribution of heat. A trough surrounds the burner stud and collects excess fuel that might leak from the wick in the event it becomes over-saturated. The collected fuel is returned to the cell by means of drain holes.

BRIEF DESCRIPTION OF DRAWINGS

For a better understanding of these and other objects of the invention, references will be made to the following detailed descriptions of the invention which are ;o be read in conjunction with the associated drawings, wherein.

DESCRIPTION OF THE INVENTION

Liquid fuel cells are generally used for warming foods and to provide intimate table lighting. Oftentimes, the user will attempt to either extend the wick to produce a higher or hotter flame or to push the wick down into the burner to reduce the flame or conserve fuel. Many of these fuel cells are disposable and are equipped with relatively inexpensive burners in which a wick is held in place at a given height a tight fit of the wick within the wick stand. Any attempt to adjust the wick usually has a deleterious effect on the wick and the operation of the burner and gives results that are quite unpredictable. Relatively small changes in wick exposure can cause great changes in flame height and the resulting illumination or heat. Also, overextending the wick can result in a flame that consumes more fuel than the wick can deliver, causing fuel starvation and ultimate burning of the wick. As will be explained below, the present invention involves a very low cost burner for use in a liquid fuel cell which contains a die-cut wick for providing the user with a predetermined and assured range of control over flame height and the amount and distribution of the heat.

Figure 1:
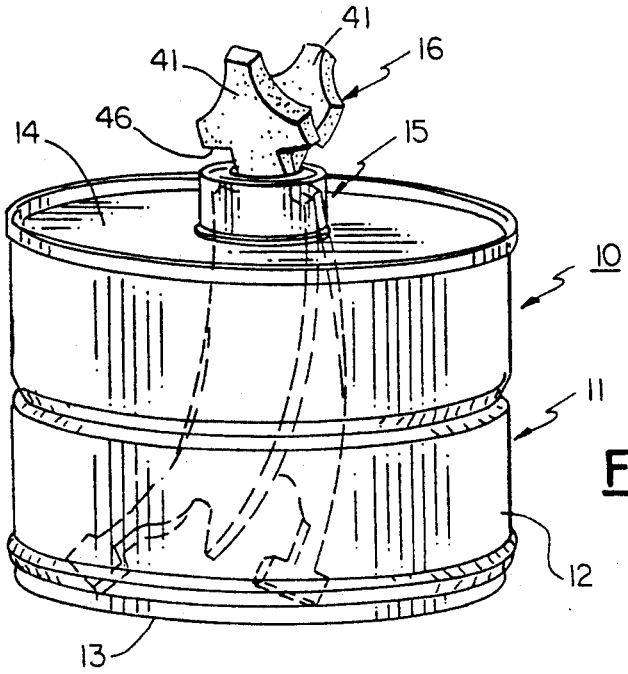
FIG. 1 is a perspective view of a liquid fuel cell containing a foldable wick embodying the teachings of the present invention.

Referring now to the drawings, a liquid fuel cell, generally referenced 10, is illustrated in FIG. 1. The fuel cell includes a container 11 having a cylindrical side wall 12 and a bottom wall 13. The container is adapted to store a quantity of liquid fuel. The top of the container is closed and sealed by means of a lid 14. A burner 15 is centrally mounted in the lid and a wick 16 slidably contained within the burner. Although not shown, a plastic cap is usually provided with the fuel cell to enclose the top of the wick. The cap is press-fitted onto the burner and thus shields and protects the wick when the fuel cell is not being used or is packaged for shipment or storage.

Figure 2:
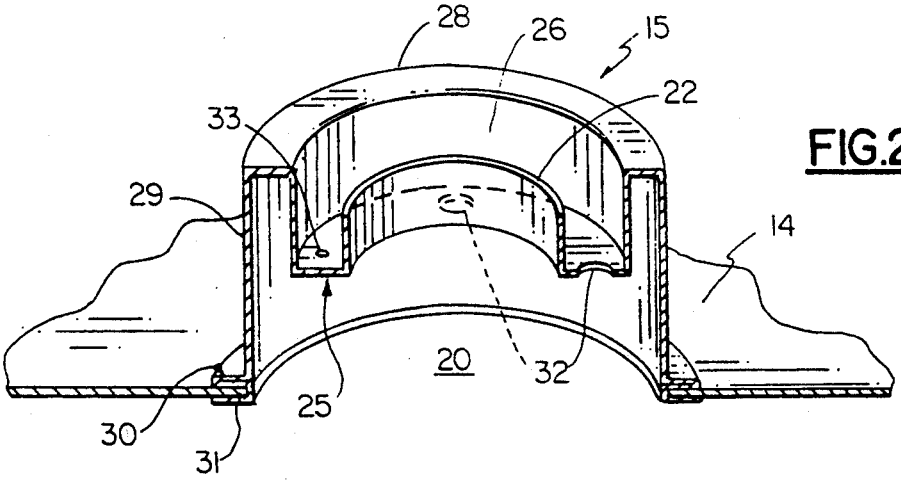
FIG. 2 is an enlarged partial view in perspective showing the burner portion of the liquid fuel cell.

As illustrated in FIG. 2, the burner 15 is formed from a single sheet of material, preferably metal, and is mounted within an opening 20 formed in the lid 14. A vertically-disposed, cylindrical stud 22 is situated in the center of the burner and is surrounded by an annular trough 25. A series of drain holes 32—32 are formed in the bottom wall 33 of the trough. The outer wall 26 of the trough in raised to an elevation that is slightly higher than that of the stud. The burner further includes a top wall 28 and an outside side wall 29 which is in parallel alignment with the outer wall 26 of the trough. The lower edge of side wall 29 is equipped with a flange 30 which is situated over the opening 20 formed in the lid. The bottom edge 31 of wall 29, which protrudes from the opening, is mechanically crimped tightly in metal to metal contact against the bottom surface of the lid to establish a leak-tight joint. Any other suitable means, such as soldering or the like, may be employed to join the burner to the lid.

Figure 3:
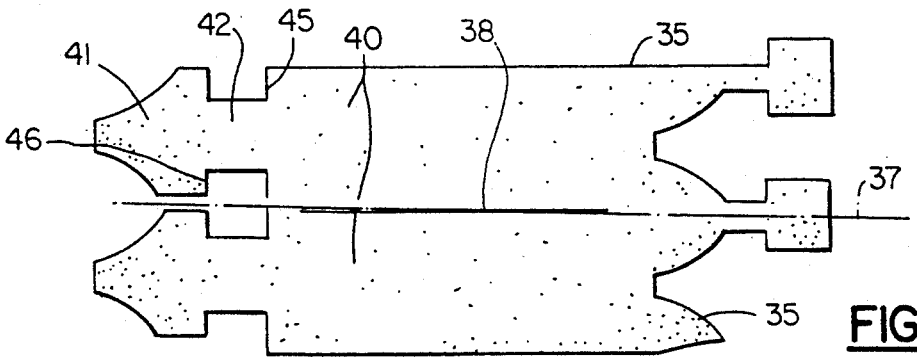
FIG. 3 is a top plan view showing the die-cut wick employed in the burner of the present liquid fuel cell.

Turning now to FIG. 3, there is shown in greater detail the construction of the wick 16 that is used in the burner 15. The wick is die-cut from a single sheet of wicking material and includes two symmetrical half-sections 31—35 that are foldable about a vertical center line 37. A vertical slit 38 is cut in the wicking material along the center line to facilitate folding the half-sections into face-to-face alignment when the wick is mounted in the burner.

Each half-section includes a lower body segment 40 and an upper tab segment 41 that are joined by a narrow neck 42 which is centered upon both the body segments and tab segments. Each tab is a triangular-shaped member having the base of the triangle lying upon the edge 46. The three corners of the triangle are truncated as shown in FIG. 3. The top edge 45 of the body segment and the bottom edge 46 of the tab segment extend laterally beyond the side edges of the neck to provide relatively wide upper and lower shoulders for the neck. The vertical length of the neck is greater than the vertical height of the burner above the lid and the distance across the shoulders is greater than the outside diameter of the vertically-disposed stud 22.

In assembly, the wick is folded along the center line 37 to place the half-sections in face-to-face alignment. The tabs are then passed upwardly through the stud until the lower edge 46 clears the top of the stud. The width across each neck segment is about equal to the inside diameter of the stud so that the neck segments substantially fill the area within the stud. As noted above, the length of each neck segment is greater than the vertical height of the stud thereby permitting the wick to be slidably repositioned within the burner. The extent of vertical travel afforded the wick is controlled by the upper and lower shoulders which are arranged to contact the top of the burner and the bottom of the wall 33 of the trough, respectively. Adjusting the height of the tabs allows for control over the flame height and thus the amount of heat produced by the burner. In addition to being able to adjust the height of the wick tabs, the tabs can be folded away from or toward each other to further control the flame geometry and the distribution of heat.

As best seen in FIG. 1, the lower body segments of the wick extend downwardly into the container and are allowed to fan out. The length of each segment is greater than the depth of the container so that the bottom of the wick rests upon the bottom of the container. The fanned segments absorb liquid fuel stored in the container and move it upwardly to the tabs via capillary action. As previously noted, the top section of the wick that is situated above the stud can become oversaturated with fuel under certain conditions. Due to the construction of the present burner, any overage of fuel is collected within the trough and then returned to the container via the drain holes 32—32. The inner wall of the trough formed by the stud 22 is lower in elevation than the outer wall 26. This insures that any overabundance of fuel will spill over the stud back into the container rather than over the outer wall of the burner thus preventing fuel from wetting the lid.

While this invention has been described in the specification and illustrated in the drawings with reference to the preferred embodiments, it is not confined to the details set forth and this application is intended to cover any modifications and changes that may come within the scope of the following claims.

What is claimed is:

1. A disposable liquid fuel cell that includes a container means for storing a quantity of liquid fuel, said container having a lid, a burner means positioned in the lid of said container, said burner means having a vertically-disposed, hollow stud of predetermined length formed therein which opens into said container, a wick means that contains a neck segment having a length greater than the length of said stud, said neck segment being slidably contained within said stud, a body segment housed within the container and extending downwardly therein, and an upper tab segment connected to the body segment by the neck segment whereby the tab segment extends upwardly above the burner means, and said neck segment further including upper and lower shoulders having a width greater than the width of said stud to restrict the vertical travel of the wick means within said burner means whereby the vertical height of the wick means above the burner means may be adjusted.

2. The liquid fuel cell of claim 1 that further includes a raised wall surrounding said stud, said raised wall forming the outer wall of a trough means for collecting excess fuel from said wick means, and a drain means in said trough means for returning excess fuel collected in said trough to said container.

3. The fuel cell of claim 2 wherein said raised outer wall has a vertical height greater than that of the stud.

4. The fuel cell of claim 2 wherein the length of the neck segment of the wick is greater than the vertical height of the outer wall of said trough and the width of the upper shoulder of said neck is greater than the width of the stud whereby the upper shoulder of the neck is arrested against the upper edge of the stud when the wick means is lowered within the burner, and the lower shoulder of the neck is arrested against the bottom of the trough when the wick means is raised within the burner.

5. The fuel cell of claim 1 wherein said wick means is formed of a single sheet of wicking material that is folded along a vertical center line into two symmetrical half-sections so that the half-sections are foldable into face-to-face alignment.

6. The fuel cell of claim 5 wherein the tab segments of the half-sections are further separated along the vertical axis to form opposed tabs that can be folded toward and away from each other to further control the flame geometry and distribution of the heat.

7. A die-cut wick formed from a single flat sheet of wicking material that is suitable for use in a fuel burner, said wick having two symmetrical half-sections separated along a vertical center line, each half-section having an elongated body segment having a horizontally-disposed top edge, a narrow neck segment centered upon the top edge of the body segment and a vertically-disposed tab segment mounted upon the neck segment, said tab segment having a horizontally-disposed bottom edge that extends laterally beyond the vertical edges of the neck segment whereby said horizontal top edge of said body and the bottom edge of the tab form top and bottom shoulders for said neck segment.

8. The wick of claim 7 wherein said sheet has a slit cut along the vertical center line between the body segments to facilitate folding of the half-sections.

9. The wick of claim 8 wherein the slit in the sheet is surrounded completely by wicking material and extends about two-thirds along the vertical length of each body segment.

10. The wick of claim 7 wherein the width of width of the bottom edge of said tab segment is slightly less than that of the top edge of said body segment whereby the tab segments are detached from each other.

11. A disposable liquid fuel cell that includes:

a container means for storing a quantity of liquid fuel, said container having a lid, a burner means positioned in the lid of said container, said burner means having a vertically-disposed, hollow stud of predetermined length formed therein which opens into said container, a wick means that contains a neck segment having a length greater than the length of said stud, said neck segment being slidably contained within said stud, said wick means being formed of a single sheet of wicking material that is folded along a vertical center line into two symmetrical half-sections so that the half-sections are foldable into face-to-face alignment a body segment housed within the container and extending downwardly therein, an upper tab segment connected to the body segment by the neck segment whereby the tab segment extends upwardly above the burner means, the tab segments of the half-sections being further separated along the vertical axis to form opposed tabs that can be folded toward and away from each other to further control the flame geometry and distribution of the heat, each tab segment having a base that is essentially a straight line aligned along the upper shoulder of one of the neck segments and the maximum width of the tab segment being the width of the base, said neck segment further including upper and lower shoulders having a width greater than the width of said stud to restrict the vertical travel of the wick means within said burner means whereby the vertical height of the wick means above the burner means may be adjusted.

12. A die-cut wick formed from a single flat sheet of wicking material that is suitable for use in a fuel burner, said wick having two symmetrical half-sections separated along a vertical center line, each half-section having an elongated body segment having a horizontally-disposed top edge, a narrow neck segment centered upon the top edge of the body segment and a vertically-disposed tab segment mounted upon the neck segment, said tab segment having a horizontally-disposed bottom edge that extends laterally beyond the vertical edges of the neck segment, with each tab segment being separated from the other and having a base which is essentially a straight line, and with the maximum width of each tab segment being the width of the base, whereby said horizontal top edge of said body and the bottom edge of the tab form top and bottom shoulders for said neck segment.

13. A disposable liquid fuel cell that includes:

a container means for storing a quantity of liquid fuel, said container having a lid, a burner means positioned in the lid of said container, said burner means having a vertically-disposed, hollow stud of predetermined length formed therein which opening into said container, a wick means that contains a neck segment having a length greater than the length of said stud, said neck segment being slidably contained within said stud, said wick means being formed of a single sheet of wicking material that is folded along a vertical center line into two symmetrical half-sections so that the half-sections are foldable into face-to-face alignment a body segment housed within the container and extending downwardly therein, an upper tab segment connected to the body segment by the neck segment whereby the tab segment extends upwardly above the burner means, the tab segments of the half-sections being further separated along the vertical axis to form opposed tabs that can be folded toward and away from each other to further control the flame geometry and distribution of the heat, wherein the tabs are triangular-shaped with the base of each triangle being aligned long the upper shoulder of one of the neck segments, said neck segment further including upper and lower shoulders having a width greater than the width of said stud to restrict the vertical travel of the wick means within said burner means whereby the vertical height of the burner means whereby the burner means may be adjusted.

14. A die-cut wick formed from a single flat sheet of wicking material that is suitable for use in a fuel burner, said wick having two symmetrical half-sections separated along a vertical center line, each half-section having an elongated body segment having a horizontally-disposed top edge, a narrow neck segment centered upon the top edge of the body segment and a vertically-disposed tab segment mounted upon the neck segment, said tab segment having a horizontally-disposed bottom edge that extends laterally beyond the vertical edges of the neck segment whereby sad horizontal top edge of said body and the bottom edge of the tab form top and bottom shoulders for said neck segment, with each tab segment being separated from the other and each tab segment being separated from the other and being triangular-shaped with the base of the triangle lying upon the bottom edge of the said tab segment.

* * * * *